US007625461B2

(12) United States Patent
Burazin et al.

(10) Patent No.: US 7,625,461 B2
(45) Date of Patent: Dec. 1, 2009

(54) MODIFIED LINKBELT MOLDING AND THROUGHDRYING FABRICS

(75) Inventors: Mark Alan Burazin, Oshkosh, WI (US); Andrew Peter Bakken, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 405 days.

(21) Appl. No.: 11/525,611

(22) Filed: Sep. 21, 2006

(65) Prior Publication Data

US 2008/0073048 A1 Mar. 27, 2008

(51) Int. Cl.
*D21F 11/00* (2006.01)
*D21H 27/02* (2006.01)
*D21H 27/40* (2006.01)

(52) U.S. Cl. ..... 162/116; 162/109; 162/111

(58) Field of Classification Search ..... 162/109, 162/110, 111, 116, 117, 348, 358.1, 358.2, 162/361, 362, 900, 902, 903; 428/152–154
See application file for complete search history.

(56) References Cited

U.S. PATENT DOCUMENTS

| | | | | |
|---|---|---|---|---|
| 4,395,308 | A | 7/1983 | Dawes | |
| 4,567,077 | A * | 1/1986 | Gauthier | 428/114 |
| 5,667,636 | A | 9/1997 | Engel et al. | |
| 6,080,691 | A | 6/2000 | Lindsay et al. | |
| 6,143,135 | A * | 11/2000 | Hada et al. | 162/290 |
| 6,149,767 | A * | 11/2000 | Hermans et al. | 162/109 |
| 6,585,858 | B1 * | 7/2003 | Otto et al. | 162/161 |
| 6,610,173 | B1 * | 8/2003 | Lindsay et al. | 162/109 |
| 6,749,719 | B2 | 6/2004 | Burazin et al. | |
| 7,005,044 | B2 * | 2/2006 | Kramer et al. | 162/362 |
| 2002/0060055 | A1 | 5/2002 | Burazin et al. | |
| 2004/0126570 | A1 | 7/2004 | Kramer et al. | |
| 2006/0124268 | A1 | 6/2006 | Billings | |
| 2006/0137840 | A1 | 6/2006 | Burazin et al. | |
| 2006/0157210 | A1 | 7/2006 | Mullally et al. | |

FOREIGN PATENT DOCUMENTS

| | | | |
|---|---|---|---|
| WO | WO 98/10142 | A1 | 3/1998 |
| WO | WO 01/48310 | A1 | 7/2001 |
| WO | WO 03/040450 | A2 | 5/2003 |

OTHER PUBLICATIONS

"Aerolink," Internet web page "http://www.albint.com/web/albint_pub.nsf/Content/Aerolink", Albany International, viewed and printed Jul. 25, 2006, 1 page.

Adanur, Sabit, "Air Permeability," *Paper Machine Clothing*, Technomic Publishing Co., Inc., Lancaster, PA, 1997, p. 89.

Adanur, Sabit, "Fabric Support Index (FSI)," *Paper Machine Clothing*, Technomic Publishing Co., Inc., Lancaster, PA, 1997, pp. 89-91.

* cited by examiner

*Primary Examiner*—Eric Hug
(74) *Attorney, Agent, or Firm*—Gregory E. Croft

(57) ABSTRACT

Throughdried tissue sheets can be made using a linkbelt throughdrying fabric and/or transfer fabric. In particular, linkbelts can be modified with topically-applied materials, such as extruded or printed silicone materials, in a pattern that provides an overall background texture and/or a decorative design that is imparted to the resulting tissue.

9 Claims, 5 Drawing Sheets

MODIFIED LINKBELT MOLDING AND THROUGHDRYING FABRICS

BACKGROUND OF THE INVENTION

In the manufacture of tissue products, it is often desirable to not only provide a product that exhibits good functional properties, but also aesthetic properties as well. For example, commonly-assigned WO 01/48310 A1 to Burazin et al. published Jul. 5, 2001, entitled "Decorative Wet Molding Fabric For Tissue Making" discloses decorative wet molding fabrics for tissue making in which a textured woven throughdrying fabric is provided with decorative designs using extruded polymeric strands or stitches, for example. While this has been effective, there are instances where the textured background of the throughdrying fabric makes it difficult to clearly see the decorative design. To address this situation, US-2006-0137840-A1 entitled "Textured Tissue Sheets Having Highlighted Design Elements" and US-2006-0157210-A1 entitled "Method of Making Tissue Sheets With Textured Nonwoven Fabrics Having Highlighted Design Elements" disclose the use of highlight areas surrounding the design elements in order to make the design elements more visible. While effective, this approach requires further modification of the throughdrying fabric, which in some instances may be undesirable because of the potential reduction in air permeability of the fabric and hence reduced drying efficiency.

Therefore there is a need for a throughdrying fabric having high air permeability and which imparts decorative designs to the tissue sheet.

SUMMARY OF THE INVENTION

It has now been discovered that linkbelts, which have been used for papermaking in other ways, can be especially useful as a molding and/or throughdrying fabric for making tissues and towels. More specifically, not only can linkbelts be used as a molding/throughdrying fabric, they can be modified with an unlimited number of surface appearances by topically applying decorative design elements and/or background texture elements to the surface of the linkbelt to produce a "modified linkbelt" (hereinafter defined). Since linkbelts inherently have a relatively smooth surface texture, decorative design elements are readily visible in the resulting sheet without the need for creating surrounding highlight areas. Enhanced visibility may also be accomplished by printing a decorative design element within an unprinted surrounding highlight area, which in turn is surrounded by a patterned background texture. The relatively smooth surface of the unprinted linkbelt provides sufficient contrast between the printed decorative design element, unprinted highlight area, and printed background texture elements. In addition, since linkbelts can be made with very high air permeability properties, overall background texture elements can also be applied to the surface of the linkbelt in order to impart a three-dimensional background texture to the resulting sheet while still retaining good drying efficiency.

Furthermore, linkbelts and modified linkbelts can also be used as a transfer fabric, which is a wet web carrier fabric positioned between the forming fabric(s) and the throughdrying fabric(s) on a tissue machine, which enables the use of various fabric combinations when making tissues or towels. These combinations include: (a) a linkbelt transfer fabric and a linkbelt throughdrying fabric; (b) a linkbelt transfer fabric and a modified linkbelt throughdrying fabric; (c) a linkbelt transfer fabric and a conventional woven throughdrying fabric; (d) a modified linkbelt transfer fabric and a modified linkbelt throughdrying fabric; (e) a modified linkbelt transfer fabric and a linkbelt throughdrying fabric; (f) a modified linkbelt transfer fabric and a conventional woven throughdrying fabric; (g) a conventional woven transfer fabric and a modified linkbelt throughdrying fabric; and (h) a conventional woven transfer fabric and a linkbelt throughdrying fabric. In all cases, the wet web can be rush transferred to the linkbelt or modified linkbelt to impart machine direction stretch to the resulting tissue sheet. When rush transfer is used, the linkbelt or modified linkbelt to which the web is being transferred can be traveling at a speed of from about 10 to about 80 percent slower than the fabric from which the wet web is being transferred.

Hence, in one aspect the invention resides in a modified linkbelt.

In another aspect, the invention resides in a method of making a tissue sheet comprising depositing an aqueous suspension of papermaking fibers onto a forming fabric to form a wet web having a consistency of from about 20 to about 40 percent or greater, more specifically from about 20 to about 30 percent, transferring the wet web to a linkbelt and throughdrying the web to produce a tissue sheet. In this aspect, the linkbelt can be a transfer fabric and/or a throughdrying fabric. Particularly when the linkbelt is used as a throughdrying fabric, the wet web is conformed to the surface of the linkbelt to impart a mirror image of the surface texture of the linkbelt to the dried tissue sheet.

In another aspect, the invention resides in a method of making a tissue sheet comprising depositing an aqueous suspension of papermaking fibers onto a forming fabric to form a wet web having a consistency of from about 20 to about 40 percent or greater, more specifically from about 20 to about 30 percent, transferring the wet web to a modified linkbelt and throughdrying the web to produce a tissue sheet. In this aspect, the modified linkbelt can be a transfer fabric and/or a throughdrying fabric. Particularly when the modified linkbelt is used as a throughdrying fabric, the wet web is conformed to the surface of the modified linkbelt to impart a mirror image of the surface texture of the modified linkbelt to the dried tissue sheet. As a result, the tissue sheet exhibits the background texture and/or the decorative design of the modified linkbelt.

As used herein, the term "tissue sheet" means a low density paper sheet, such as sheets used for facial tissue, bath tissue, paper towels, table napkins and the like. The basis weight can be from about 10 to about 120 grams per square meter (gsm), more specifically from about 10 to about 45 gsm, more specifically from about 10 to about 35 gsm, more specifically from about 20 to about 35 gsm, more specifically from about 20 to about 30 gsm and still more specifically from about 30 to about 35 gsm. Such sheets can also be characterized by a bulk of about 4 cubic centimeters or greater per gram as measured under a load of about 90 grams per square inch (6.45 square centimeters) by conventional methods. For purposes herein, tissue sheets can be made by any throughdrying process known in the art which includes the steps of forming, dewatering and throughdrying. The tissue sheets can be creped or uncreped.

As used herein, a "linkbelt" is a papermaking fabric made of a plurality of spiral coils positioned side-by-side in an overlapping manner to create channels and assembled together with a plurality of rods inserted through the channels. Such fabrics are disclosed and described in U.S. Pat. No. 4,567,077 issued Jan. 28, 1986 to Gauthier and U.S. Patent Application No. 2006/0124268 A1 to Billings published Jun. 15, 2006, both of which are herein incorporated by reference.

Linkbelts are commercially available from Albany International under the name "Aerolink" or from Voith Fabrics under the name "Finelink".

As used herein, a "decorative design" is a decorative figure, icon or shape such as a flower, heart, puppy, logo, trademark, word(s) and the like. The decorative design can be formed by raised areas (elements) which give the decorative design a topography that distinguishes it from the surrounding linkbelt surface. These elements can suitably be one or more lines, segments, dots or other shapes.

As used herein, the term "textured background surface" means an overall background surface having a three-dimensional topography with z-directional elevation differences of about 0.2 millimeter or greater. The topography can be regular or irregular. The background surface is the overall predominant surface of the fabric, excluding any portions of the surface occupied by any highlight areas or decorative design elements. Suitable textured background surfaces include surfaces generally having alternating ridges and valleys or bumps and depressions. To distinguish from decorative designs, the frequency of alternating ridges and valleys in textured background patterns can be about 20 or greater per 10 centimeters. Similarly, the density of the bumps and depressions for textured background patterns can be about 3 or greater per square centimeter.

As used herein, the term "highlight area" means a surface area that has substantially less texture than the surrounding textured background surface, or has no texture, so that the decorative design elements are easily distinguishable by the user of the tissue sheet. The unmodified surface areas of standard linkbelts are particularly suited for providing highlight areas since such linkbelts have relatively flat surfaces.

As used herein, "topically-applied" refers to any method of adding material to or incorporating material within the tissue web-contacting surface of the linkbelt to alter the surface topography of the linkbelt and the resulting tissue sheet. Particularly suitable methods of topical application are printing or extruding polymeric material onto the surface. Alternative methods include applying cast or cured films, weaving, embroidering or stitching polymeric fibers into the surface to create patterns or embossing. Particularly suitable polymeric materials include materials that can be strongly adhered to the linkbelt and are resistant to thermal degradation at typical tissue machine dryer operating conditions (120° C. to 210° C.) and are reasonably flexible, such as silicones, polyesters, polyurethanes, epoxies, polyphenylsulfides and polyetherketones.

As used herein, a "modified linkbelt" is a linkbelt having a topically-applied material in the form of a decorative design and/or a topically-applied material in the form of a textured background surface.

The dimensions of the elements (lines, dots, and the like) of topically-applied materials are such that resulting pattern of elements is detectable in the resulting tissue. By way of example, extruded lines of material used to create the puppy images in FIG. 1 have a height of about 0.35 millimeter (mm). The elements of the other patterns illustrated in FIGS. 2, 3 and 4 are of similar dimensions. In general, the height of the topically-applied elements can be from about 0.2 to about 2 millimeters, more specifically from about 0.3 to about 1.7 millimeters and still more specifically from about 0.4 to about 1.4 millimeters. The width of the topically-applied elements can be from about 0.2 to about 2 millimeters, more specifically from about 0.3 to about 1.7 millimeters and still more specifically from about 0.4 to about 1.4 millimeters.

The air permeability of the linkbelt or modified linkbelt throughdrying fabric of this invention can be about 100 cubic meters per minute per square meter ($m^3/min/m^2$) or greater, more specifically from about 100 to about 340 $m^3/min/m^2$ and still more specifically from about 150 to about 340 $m^3/min/m^2$. The air permeability can be adjusted by the design of the linkbelt, including the diameter of the spiral coils, the geometry of the coils, the presence of filler strands within the linkbelt, the topically-applied textured background pattern, the topically-applied decorative design elements, etc. Air permeability can be measured by the Frasier air permeability test, Paper Machine Clothing, Sabit Adanur, Technomic Publishing Company (1997) page 89.

The percentage of the surface area of the linkbelt or modified linkbelt occupied by the topically-applied strands or other elements of the decorative design patterns or background surface texture patterns can be from 0 to about 80 percent, more specifically from about 1 to about 80 percent and still more specifically from about 5 to about 50 percent. While the air permeability of the modified linkbelt will generally decrease as the area covered by the topically-applied elements increases, the linkbelt design inherently provides for such high levels of air permeability that in many cases the decrease in air permeability will not be a controlling factor for commercial production.

The fabric support index of the linkbelt or modified linkbelt needs to be sufficiently high to support the topically-applied material and the fibers in the wet web. In particular, the fabric support index can be about 20 or greater, more specifically about 25 or greater. The fabric support index can be determined by calculation in accordance with Paper Machine Clothing, Sabit Adanur, Technomic Publishing Company (1997), page 90.

EXAMPLES

Example 1

Figure 1:
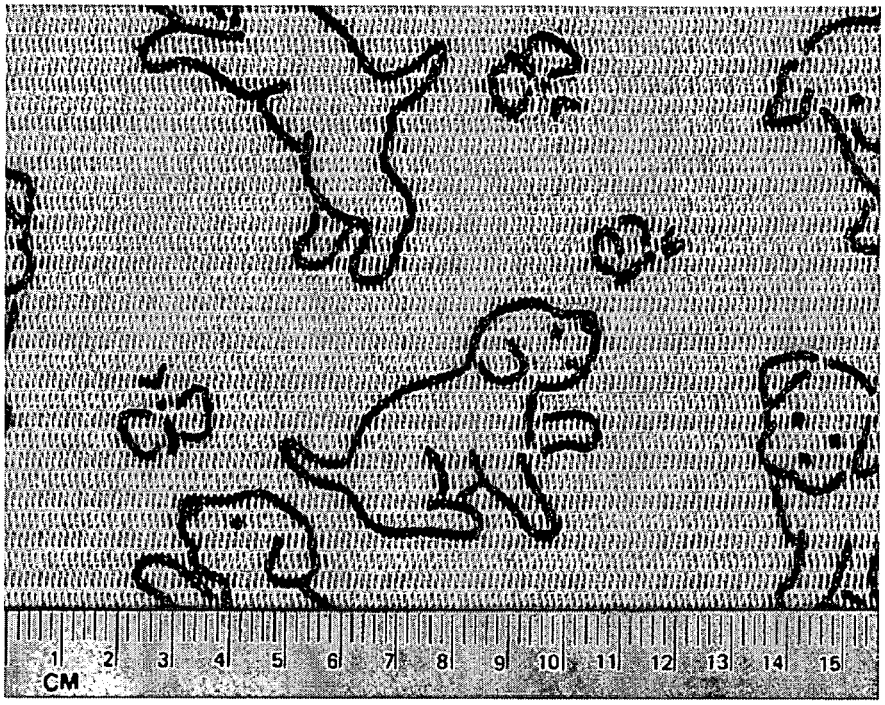
FIG. 1 is a plan view photograph of a modified linkbelt in accordance with this invention having decorative design elements, namely puppies and butterflies. The base linkbelt is a Voith Fabrics Finelink BC.

In order to further illustrate this invention, a three-layered tissue sheet suitable for single-ply bath tissue was made in which the two outer layers comprised a debonded mixture of Aracruz eucalyptus fibers and broke fibers and the center layer comprised refined northern softwood kraft (NSWK) fibers. Broke fibers comprised 16.5 percent of the sheet on a dry fiber basis. Prior to formation, the outer layer fibers were pulped for 15 minutes at 10 percent consistency and diluted to about 2.5 percent consistency after pulping. A debonder (ProSoft TQ1003) was added to the outer layer pulp in the amount of 1 kilogram of debonder per tonne of outer layer dry fiber. The NSWK fibers were pulped for 30 minutes at 4 percent consistency and diluted to about 2.7 percent consistency after pulping. The overall layered sheet weight was split 34 percent to the center layer on a dry fiber basis and 33 percent to each of the outer layers. The center layer was refined to levels required to achieve target strength values, while the outer layers provided surface softness and bulk. Parez 631NC was added to the center layer at 1.5 kilograms per tonne of center layer dry fiber.

A three-layer headbox was used to form the wet web with the refined NSWK stock in the center layer of the headbox. Turbulence-generating inserts recessed about 3.5 inches (89 millimeters) from the slice and layer dividers extending about 1 inch (25 millimeters) beyond the slice were employed. The net slice opening was about 0.9 inch (23 millimeters). The water flows in the headbox layers were split 28.5 percent to each of the outer layers and 43 percent to the center layer. The consistency of the stock fed to the headbox was about 0.1 weight percent.

The resulting three-layered web was formed on a twin-wire, suction form roll former, with the outer forming fabric being an Asten 867A, and the inner forming fabric being a Voith Fabrics 2164-33B. The speed of the forming fabrics was 2000 feet per minute (10.16 meters per second). The newly-formed web was then dewatered to a consistency of about 27-29 percent using vacuum suction from below the forming fabric before being transferred to a transfer fabric, which was traveling at 1600 feet per minute (8.13 meters per second) (25 percent rush transfer). The transfer fabric was a Voith Fabrics t1207-6. A vacuum shoe pulling about 10 inches (254 mm) of mercury rush transfer vacuum was used to transfer the web to the transfer fabric.

Figure 3:
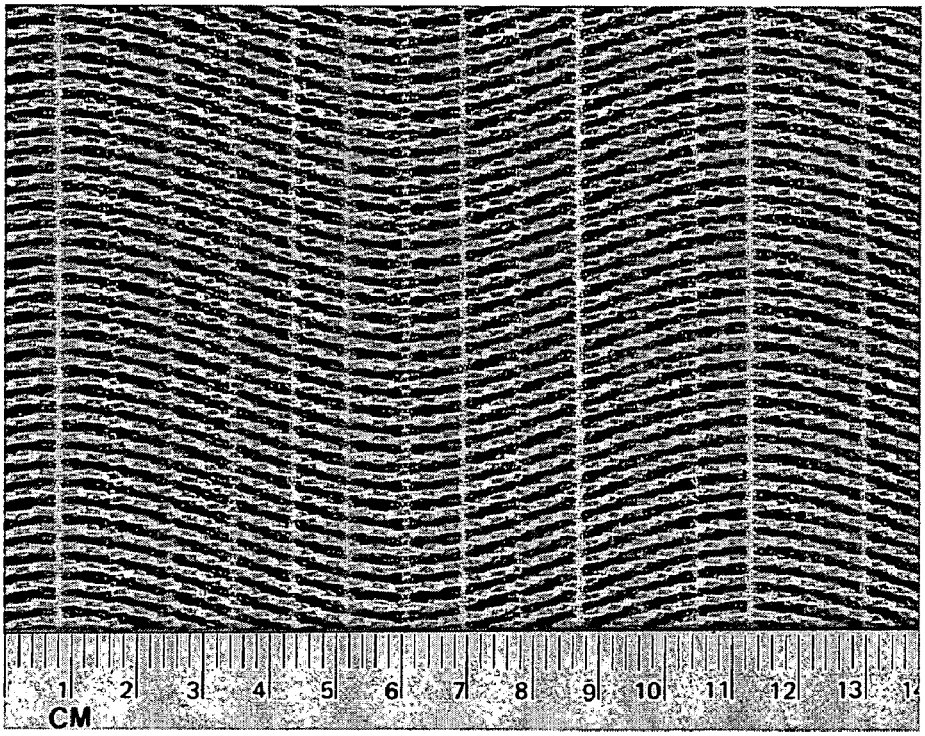
FIG. 3 is a plan view photograph of a modified linkbelt in accordance with this invention having a textured background surface formed by a series of wavy ripples. The base linkbelt is a Voith Fabrics Finelink BC.

The web was then transferred to a Voith Fabrics Finelink BC linkbelt throughdrying fabric modified with a printed pattern as shown in FIG. 3. The air permeability of the modified linkbelt was about 150 $m^3/min/m^2$.

A vacuum transfer roll was used to wet mold the sheet into the throughdrying fabric at about 8 inches (203 mm) of mercury wet molding vacuum. The throughdrying fabric was traveling at a speed of about 8.13 meters per second. The web was carried over a pair of Honeycomb throughdryers operating at a supply temperature of about 390° F. (199° C.) and dried to final dryness of about 99 percent consistency.

Figure 6:
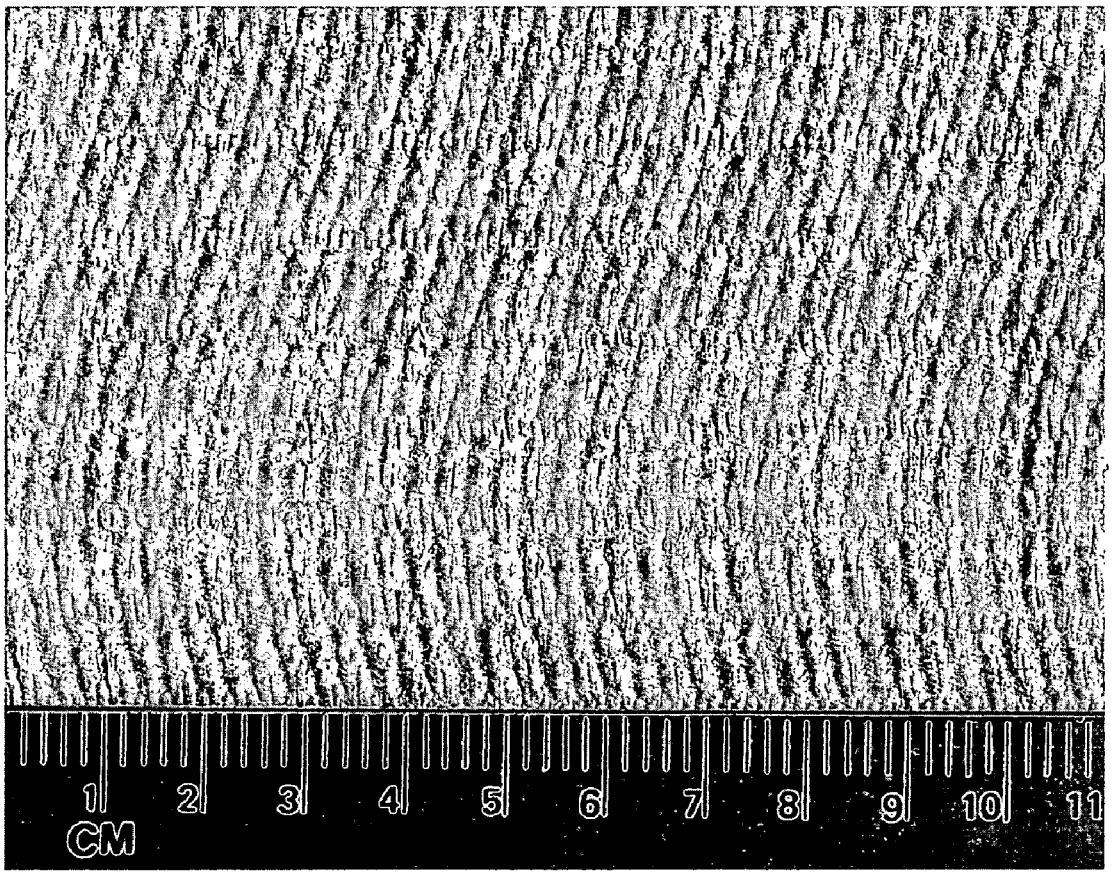
FIG. 6 is a plan view photograph of a tissue sheet made using the modified linkbelt of FIG. 3.

The resulting tissue is shown in FIG. 6. It had a basis weight of 31.0 gsm, a geometric mean tensile strength of 704 grams per 7.62 centimeters of width, a ratio of the machine direction tensile strength to the cross-machine direction tensile strength of 1.72, and a caliper of 840 microns.

Example 2

Figure 4:
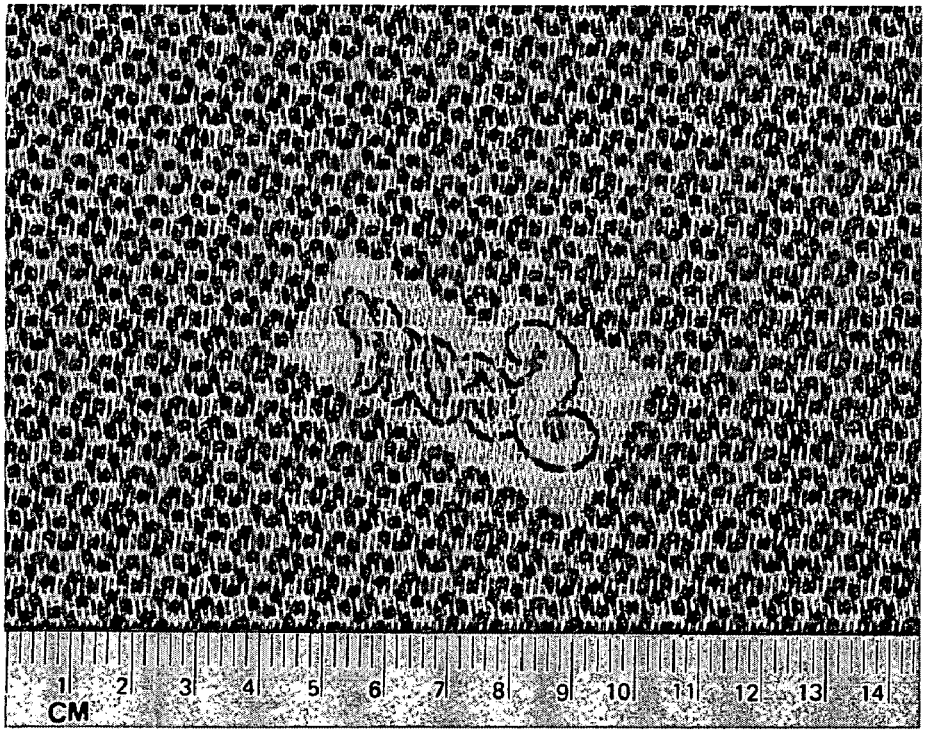
FIG. 4 is a plan view photograph of a modified linkbelt in accordance with this invention having both decorative design elements and textured background surface elements, namely a printed "Scott" logo decorative design element surrounded by a relatively flat unprinted highlight area within a printed textured background surface comprising a series of closely-spaced four-dot elements. The base linkbelt is a Voith Fabrics Finelink BC.

Tissue sheets were made as described in Example 1, except that the speed of the forming fabrics was 2048 feet per minute (10.40 meters per second, 28% rush transfer) and the throughdrying fabric was a Voith Fabrics Finelink BC linkbelt modified with a printed pattern as shown in FIG. 4. The air permeability of the modified linkbelt was about 160 $m^3/min/m^2$.

Figure 7:
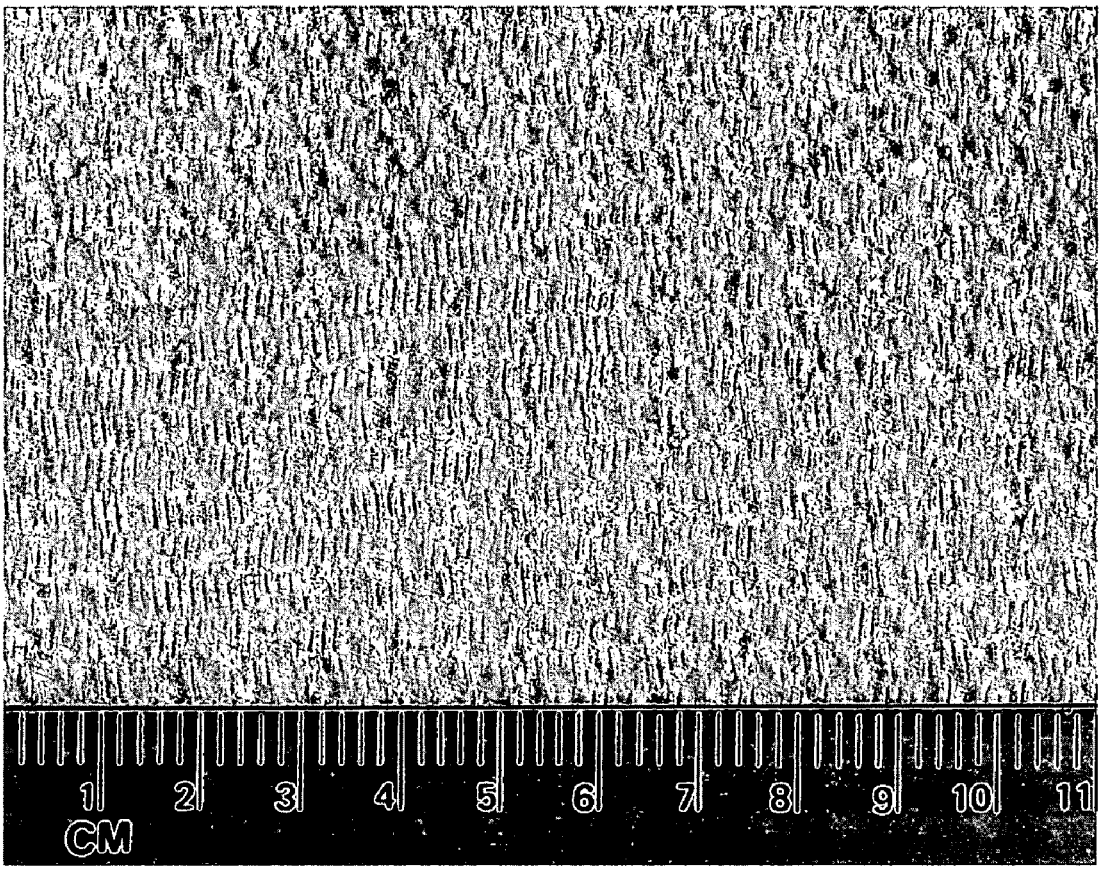
FIG. 7 is a plan view photograph of a tissue sheet made using the modified linkbelt of FIG. 4.

The resulting tissue is shown in FIG. 7. It had a basis weight of 31.2 gsm, a geometric mean tensile strength of 936 grams per 7.62 centimeters of width, a ratio of the machine direction tensile strength to the cross-machine direction tensile strength of 1.83 and a caliper of 853 microns.

Example 3

Figure 2:
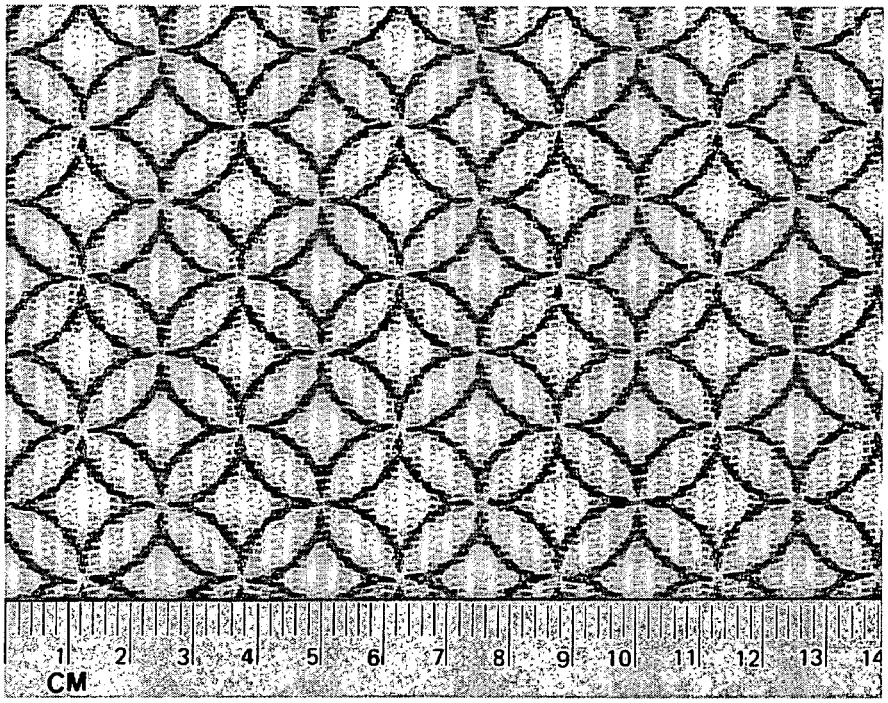
FIG. 2 is a plan view photograph of a modified linkbelt in accordance with this invention having a decorative design formed by geometric design elements comprising intersecting circles (wedding ring pattern). The base linkbelt is a Voith Fabrics Finelink BC.

Tissue sheets were made as described in Example 2, except that the throughdrying fabric was a Voith Fabrics Finelink BC linkbelt modified with a printed pattern as shown in FIG. 2. The air permeability of the modified linkbelt was about 220 $m^3/min/m^2$.

Figure 5:
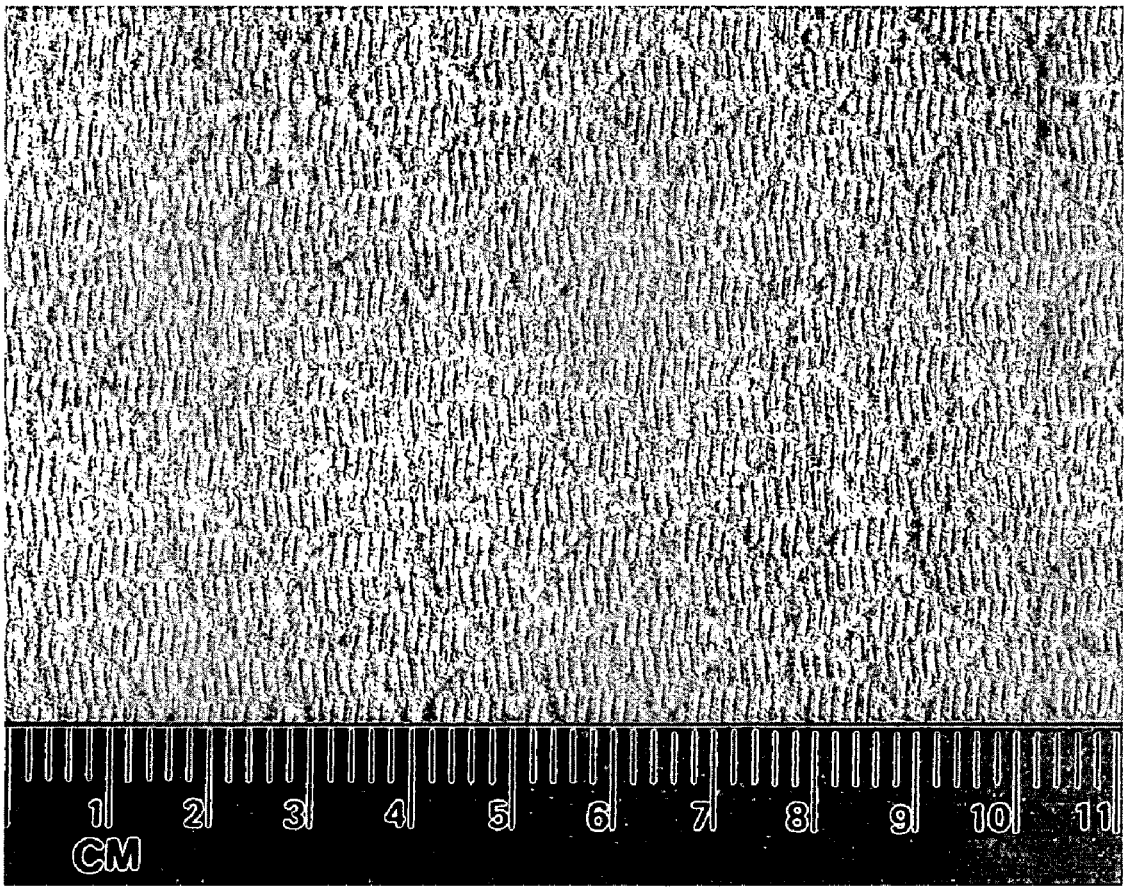
FIG. 5 is plan view photograph of a tissue sheet made using the modified linkbelt of FIG. 2.

The resulting tissue is shown in FIG. 5. It had a basis weight of 31.1 gsm, a geometric mean tensile strength of 830 grams per 7.62 centimeters of width, a ratio of the machine direction tensile strength to the cross-machine direction tensile strength of 1.75, and a caliper of 644 microns.

It will be appreciated that the foregoing examples, given for purposes of illustration, are not to be construed as limiting the scope of this invention, which is defined by the following claims and all equivalents thereto.

We claim:

1. A method of making a tissue sheet comprising depositing an aqueous suspension of papermaking fibers onto a forming fabric to form a wet web having a consistency of from about 20 to about 40 percent, transferring the wet web from the forming fabric to a modified linkbelt transfer fabric and throughdrying the web to produce a tissue sheet.

2. The method of claim 1 wherein the wet web is transferred from the modified linkbelt transfer fabric to a linkbelt throughdrying fabric.

3. The method of claim 1 wherein the wet web is transferred from the modified linkbelt transfer fabric to a modified linkbelt throughdrying fabric.

4. The method of claim 1 wherein the wet web is transferred from the modified linkbelt transfer fabric to a conventional woven throughdrying fabric.

5. The method of claim 1 wherein the consistency of the wet web is from about 20 to about 30 percent.

6. The method of claim 1 wherein the throughdried web is creped.

7. The method of claim 1 wherein the throughdried web is uncreped.

8. The method of claim 2, 3 or 4 wherein the speed of the throughdrying fabric is from about 10 to about 80 percent slower than the speed of the forming fabric.

9. The method of claim 1, 2, 3 or 4 wherein the speed of the transfer fabric is from about 10 to about 80 percent slower than the speed of the forming fabric.

* * * * *

UNITED STATES PATENT AND TRADEMARK OFFICE

CERTIFICATE OF CORRECTION

PATENT NO. : 7,625,461 B2
APPLICATION NO. : 11/525611
DATED : December 1, 2009
INVENTOR(S) : Burazin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 476 days.

Signed and Sealed this

Second Day of November, 2010

David J. Kappos

David J. Kappos
*Director of the United States Patent and Trademark Office*